US008084724B1

(12) United States Patent
Brosch et al.

(10) Patent No.: US 8,084,724 B1
(45) Date of Patent: Dec. 27, 2011

(54) ENHANCED MULTIPLE KILL VEHICLE (MKV) INTERCEPTOR FOR INTERCEPTING EXO AND ENDO-ATMOSPHERIC TARGETS

(75) Inventors: R. Glenn Brosch, Sorrento, FL (US); Darin S. Williams, Tucson, AZ (US); Kent P. Pflibsen, Tucson, AZ (US); Thomas M. Crawford, Marana, AZ (US)

(73) Assignee: Raytheon Company, Waltham, MA (US)

( * ) Notice: Subject to any disclaimer, the term of this patent is extended or adjusted under 35 U.S.C. 154(b) by 1433 days.

(21) Appl. No.: 11/344,853

(22) Filed: Feb. 1, 2006

(51) Int. Cl.

| | |
|---|---|
| ***F41G 7/00*** | (2006.01) |
| ***F42B 15/01*** | (2006.01) |
| ***F42B 15/10*** | (2006.01) |
| *F42B 15/00* | (2006.01) |

(52) U.S. Cl. ..... 244/3.16; 244/3.1; 244/3.15; 244/3.17; 244/3.18; 244/158.1; 89/1.11; 342/61; 342/62

(58) Field of Classification Search ..... 244/3.1–3.3, 244/158.1, 158.4–158.8, 164–171.5; 89/1.11; 342/52–55, 61–62

See application file for complete search history.

(56) References Cited

U.S. PATENT DOCUMENTS

| | | | | |
|---|---|---|---|---|
| 5,260,709 | A | 11/1993 | Nowakowski | |
| 5,456,425 | A * | 10/1995 | Morris et al. | 244/3.22 |
| 5,710,423 | A * | 1/1998 | Biven et al. | 244/3.1 |
| 6,481,666 | B2 | 11/2002 | Frucht | |
| 6,549,158 | B1 | 4/2003 | Hanson | |
| 6,563,450 | B1 | 5/2003 | Wallace | |
| 6,603,421 | B1 | 8/2003 | Schiff et al. | |
| 6,817,568 | B2 | 11/2004 | Spate et al. | |
| 7,219,853 | B2 * | 5/2007 | Williams | 244/3.14 |
| 7,415,917 | B2 * | 8/2008 | Lloyd | 89/1.11 |
| 7,494,089 | B2 * | 2/2009 | Williams et al. | 244/3.16 |
| 7,513,455 | B1 * | 4/2009 | Mavroudakis et al. | 244/3.15 |
| 2001/0025901 | A1 | 10/2001 | Frucht | |
| 2004/0169107 | A1 | 9/2004 | Spate et al. | |

* cited by examiner

*Primary Examiner* — Bernarr Gregory
(74) *Attorney, Agent, or Firm* — Eric A. Gifford

(57) ABSTRACT

By sharing tasks between the CV and the KVs, the MKV interceptor provides a cost-effective missile defense system capable of intercepting and killing multiple targets. The placement of the acquisition and discrimination sensor and control sensor on the CV to provide target acquisition and discrimination and mid-course guidance for all the KVs avoids the weight and complexity issues associated with trying to "miniaturize" unitary interceptors. The placement of either a short-band imaging sensor and headlamp or a MWIR sensor on each KV overcomes the latency, resolution and bandwidth problems associated with command guidance systems and allows each KV to precisely select a desirable aimpoint and maintain track on that aimpoint to impact. An implicit divert and attitude control system (DACS) using tow or more divert thrusters performs KV divert and attitude maneuvers to respond to the command guidance pre-handover and to maintain track on the aimpoint to terminal intercept post-handover.

24 Claims, 15 Drawing Sheets

136

| | 1. deg FOV | | | 1.5 deg FOV | | | 2. deg FOV | | |
|---|---|---|---|---|---|---|---|---|---|
| #STARS | MIN | AVG | MAX | MIN | AVG | MAX | MIN | AVG | MAX |
| 1 | 0. | 0. | 0. | 0. | 0. | 0. | 0. | 0. | 0. |
| 2 | 0. | 2.91468 | 11.1144 | 0. | 2.72879 | 11.1144 | 0. | 2.55746 | 11.1144 |
| 3 | 0.00476469 | 4.00093 | 11.1663 | 0.00476469 | 3.93173 | 11.1663 | 0.00476469 | 3.828 | 11.1663 |
| 4 | 0.115563 | 4.72631 | 12.1027 | 0.115563 | 4.71692 | 12.1027 | 0.115563 | 4.68338 | 12.1027 |
| 5 | 0.266396 | 5.32641 | 12.3101 | 0.266396 | 5.32261 | 12.3101 | 0.266396 | 5.31306 | 12.3101 |
| 6 | 0.358152 | 5.85698 | 12.8048 | 0.358152 | 5.85546 | 12.8048 | 0.358152 | 5.8502 | 12.8048 |
| 7 | 0.513974 | 6.34801 | 12.997 | 0.513974 | 6.34588 | 12.997 | 0.513974 | 6.34477 | 12.997 |
| 8 | 0.699641 | 6.79847 | 13.3885 | 0.699641 | 6.79769 | 13.3885 | 0.699641 | 6.79582 | 13.3885 |
| 9 | 0.750355 | 7.22495 | 13.8909 | 0.750355 | 7.22432 | 13.8909 | 0.750355 | 7.22335 | 13.8909 |
| 10 | 1.29119 | 7.63436 | 14.1378 | 1.22915 | 7.63381 | 14.1378 | 1.22915 | 7.63348 | 14.1378 |

ENHANCED MULTIPLE KILL VEHICLE (MKV) INTERCEPTOR FOR INTERCEPTING EXO AND ENDO-ATMOSPHERIC TARGETS

GOVERNMENT RIGHTS

This invention was made with United States Government support under contract DASG60-02-C-0027 awarded by the U.S. Army Strategic Defense Command. The United States Government has certain rights in the invention.

BACKGROUND OF THE INVENTION

1. Field of the Invention

This invention relates to missile defense systems, and in particular, but not exclusively, to a system for intercepting and destroying exo-atmospheric missiles using kinetic energy kill vehicles.

2. Description of the Related Art

Ballistic missiles armed with conventional explosives, chemical, biological or nuclear warheads represent a real and growing threat to the United States from the former Soviet Union, terrorist states and terrorist groups. The technologies required to both create weapons of mass destruction (WMD) and to deliver them over hundreds to thousands of miles are available and being aggressively sought by enemies of the United States.

Several modern missile defense systems are under development by branches of the US Armed Services and Department of Defense. These systems use an (interceptor) missile to destroy an incoming (target) missile, warhead, reentry vehicle, etc. . . . . Blast-fragmentation systems detonate high power explosives shortly before the collision of the interceptor with the target. Kinetic energy systems rely solely on the kinetic energy of the interceptor to destroy the target. Both systems require highly sophisticated guidance systems to acquire and track the target. In particular, kinetic energy systems must hit the target with great precision.

U.S. Pat. Nos. 4,738,411 and 4,796,834 to Ahlstrom describe techniques for guiding explosive projectiles toward the target. In the '411 patent, the magazine is loaded with transmitting projectiles with means for illuminating the target with electromagnetic radiation and explosive projectiles with a passive or purely receiving homing device. During the last part of its travel, the transmitting projectile illuminates the target area with electromagnetic energy. A preferred wavelength range is the so called millimeter wavelength range, suitably 3-8 mm. Energy reflected off of any targets within the target area is received by the explosive projectiles and used to guide the projectiles toward the target. The mm band is adequate to detect the target and possibly strike the target but is not adequate to select a particular aimpoint on the target. In the '834 patent, each of the explosive projectiles includes illumination means and a passive receiver. A leading projectile passively detects and then illuminates a target. A trailing projectile detects the return energy off of the illuminated target and corrects its trajectory accordingly. When the leading projectile hits the ground, the trailing projectile senses the interruption and resets itself to passive detection. When the target's own radiation is detected, the passive signature is used for final guidance. The detector device for activating the illumination source is preferably the same detector as that included in the target tracking device.

Raytheon's EKV (Exo-Atmospheric Kill Vehicle) system represents state-of-the-art in kinetic energy systems designed to locate, track and collide with a ballistic missile. The EKV is a unitary interceptor that includes a single kill vehicle (KV). The interceptor is launched on a multi-stage rocket booster. Current versions of the kill vehicle have optical sensors to support the endgame functions including: acquisition of the target complex, resolution of the objects, tracking the credible objects, discrimination of the target objects and homing in on the target warhead.

The deployment of missiles with Multiple Independently Targeted Re-entry Vehicles (MIRVs) is driving a move to develop interceptors that can deploy multiple kill vehicles. A multiple kill vehicle (MKV) interceptor would include a carrier vehicle (CV) and multiple KVs. The development of an MKV interceptor presents unique problems of weight, miniaturization, and control bandwidth to acquire, track and intercept multiple targets in addition to all the issues encountered by unitary interceptors. Consequently, an effective MKV interceptor has not yet been developed or deployed.

One concept being pursued is to simply miniaturize existing unitary interceptors such as the EKV. In this approach, each KV includes all of the intelligence needed to discriminate targets and provide guidance to impact. The CV is merely a bus to transport the KVs from launch to release. Unfortunately, the ability to "miniaturize" all the functionality into a small, lightweight KV is well beyond state-of-the-art and may never be realizable due to fundamental physics constraints.

Another concept is to "command guide" all of the KVs from the CV to impact. In this approach all of the intelligence needed to discriminate targets and provide guidance to impact is located on the CV. The KVs include minimal functionality, typically only a receiver and actuators to respond to the heading commands sent by the CV. U.S. Pat. No. 4,925,129 describes a missile defense system including a guided projectile including multiple sub-projectiles. A radar tracker is used to guide the projectile toward a target at relatively large distances. An optical tracker on the projectile is used to track the target at relatively small distances and issue guidance commands to guide the sub-projectiles to intercept the target. Although conceptually attractive, command guidance suffers from poor target resolution and latency associated with the stand-off range of the CV to keep all targets within the optical tracker's field of regard, which makes aimpoint selection and terminal guidance imprecise. Recent studies have shown precise aimpoint selection and terminal guidance to strike the aimpoint are critical to the success of kinetic energy systems. Furthermore, the CV must have sufficient bandwidth to track all of the targets simultaneously.

SUMMARY OF THE INVENTION

The present invention provides a MKV interceptor capable of acquiring, tracking and intercepting multiple targets at precise aimpoints without overstressing the design of the CV or individual KVs. The tasks required to acquire, track and intercept multiple incoming targets are distributed between the CV and the KVs.

This is accomplished with an MKV interceptor comprising a CV and a plurality of KVs initially stored in the CV for release to intercept incoming targets. The CV includes a first sensor subsystem for acquiring and tracking the targets and providing heading commands to the released KVs pre-handover. Each KV includes an imaging sensor subsystem for selecting a desirable aimpoint on the target post-handover and maintaining track on the aimpoint to terminal intercept. A divert and attitude control system (DACS) performs divert and attitude maneuvers to respond to the command guidance pre-handover and to maintain track on the aimpoint to terminal intercept post-handover. The placement of the first sensor subsystem on the CV to provide acquisition and mid-course guidance for all the KVs avoids weight and complexity issues associated with trying to "miniaturize" unitary interceptors. The placement of the imaging sensor on each KV overcomes the latency, resolution, field of regard, and bandwidth problems associated with command guided systems.

In a first exemplary embodiment, the imaging sensor subsystem is preferably a short-band imaging sensor that at a certain range-to-target post-handover provides sufficient independent pixels on target to use the shape and orientation of the target to select the aimpoint. Such a short-band imaging sensor cannot adequately detect passive signatures and thus the target must be illuminated. On-board illumination for terminal intercept is provided by a headlamp mounted on the KV. The targets may be illuminated from CV prior to entering terminal track. The headlamp overcomes problems of "bi-static illumination" and brings out the entire image silhouette thereby improving aimpoint fidelity. In a preferred embodiment, the headlamp is short-pulsed and the imaging sensor is gated to a very narrow window to suppress dark current and improve SNR. As the range-to-target closes, the FOV of the headlamp may be increased to maintain coverage of the target.

In a second exemplary embodiment, the imaging sensor subsystem use a MWIR imaging sensor on the KV to provide suitable resolution for aimpoint selection and terminal guidance without a headlamp. To provide the same resolution as the short-band sensor, the MWIR sensor will require a larger aperture, and thus will be heavier. The MWIR may be used for passive acquisition at handover but is range limited in earth umbra. Alternately, the KV may include an LWIR sensor for initial passive handover at longer ranges, transitioning to the MWIR for terminal intercept. If the imaging subsystem includes both LWIR and MWIR sensors, the optics may be controlled to focus at infinity for optimal unresolved target acquisition with the LWIR sensor and to focus at a shorter distance for better resolution using the MWIR sensor.

In a third exemplary embodiment, each KV includes an implicit attitude control system (ACS) that includes at least two divert thrusters having two-axis articulation about nominal thrust axes that are off-axis from the body axis of the KV. At least two of the divert thrusters are spaced on the KV so that their nominal lines of thrust are separated by more than 90°. The at least two divert thrusters provide divert and attitude control in all three axis; yaw, pitch and roll. Although two divert thrusters can provide 3-axis control, certain intermediate maneuvers may be required to achieve all three axis. Three divert thrusters can provide 3-axis control directly but may require compensatory thrust to achieve pure attitude control. A preferred four thruster configuration provides efficient 3-axis control. The implicit ACS can be used to align the divert thrusters through the KV's center-of-gravity to negate or at least minimize any attitude disturbances induced by pure divert maneuvers. Furthermore, the implicit ACS can be used to misalign the divert thrusters to be offset from the center-of-gravity to create a desired attitude control.

These and other features and advantages of the invention will be apparent to those skilled in the art from the following detailed description of preferred embodiments, taken together with the accompanying drawings, in which:

DETAILED DESCRIPTION OF THE INVENTION

The present invention describes a miniature kill vehicle (MKV) interceptor for intercepting targets. The particular MKV interceptor described herein is for exo-atmospheric interceptors. Atmospheric drag requires different CV and KV designs although the principles are applicable.

As an overview, the presence of an incoming target is detected and signaled to the battlefield management system by an early warning system and an MKV interceptor is launched on a path to intercept the target. At a certain range to the target cloud, the CV releases the KVs and preferably deploys them in waves out in front of the CV. An exemplary CV includes a LWIR discrimination and acquisition sensor subsystem for passively acquiring and discriminating real targets based on external cues and refining the track and a short-band control sensor subsystem for actively tracking the targets and KVs and command guiding the KVs pre-handover. At some range to target the CV hands over the target designation and tracking information and responsibility to each KV. Each KV uses its imaging sensor subsystem to select a desirable aimpoint and maintain track on the aimpoint to terminal intercept. The imaging sensor is suitably a short-band signature that detects a return signature reflected off a target illuminated by a headlamp on-board the KV. Alternately, the imaging sensor is suitably a passive MWIR or a combination of a passive LWIR and MWIR to acquire the targets, select the aimpoint and track to intercept.

By sharing tasks between the CV and the KVs, the MKV interceptor provides a cost-effective missile defense system capable of intercepting and killing multiple targets. The placement of the first sensor subsystem on the CV to provide target acquisition and discrimination and mid-course guidance for all the KVs avoids the weight and complexity issues associated with trying to "miniaturize" unitary interceptors. The placement of an imaging sensor on each KV overcomes the latency, resolution and bandwidth problems associated with command guidance systems and allows each KV to precisely select a desirable aimpoint and maintain track on that aimpoint to impact.

The MKV interceptor is a very complex system including much functionality outside the scope of the invention. Consequently, the diagrams and descriptions of the CV, KVs and methods of discrimination, acquisition and guidance are limited to the subject matter of the present invention for purposes of clarity and brevity. Other functionality is well known to those skilled in the art of missile defense systems using kinetic energy interceptors.

Figure 1:
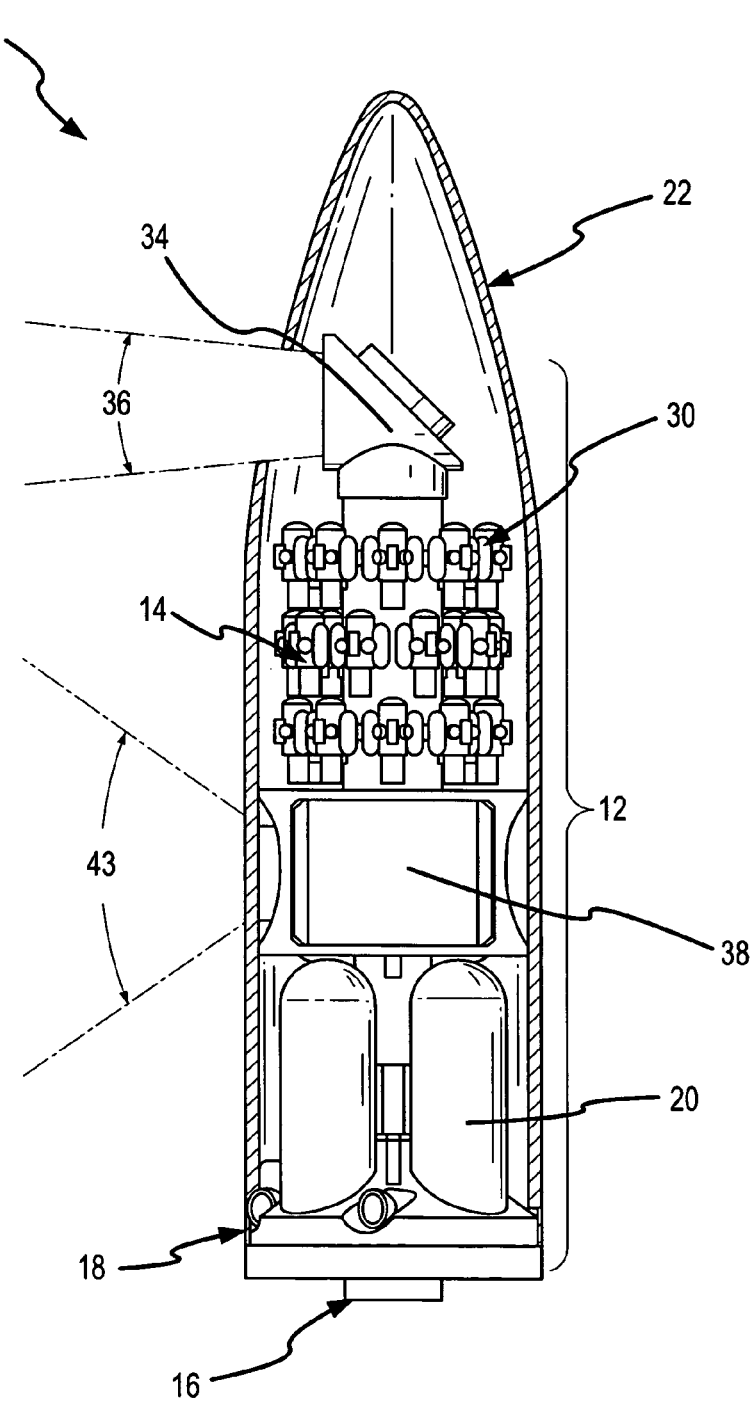
FIG. 1 is a simplified diagram of an MKV interceptor including a booster stage, a carrier vehicle lofted by the booster, and a plurality of KVs initially stored in the carrier vehicle and then released to intercept the targets.
Figure 2:
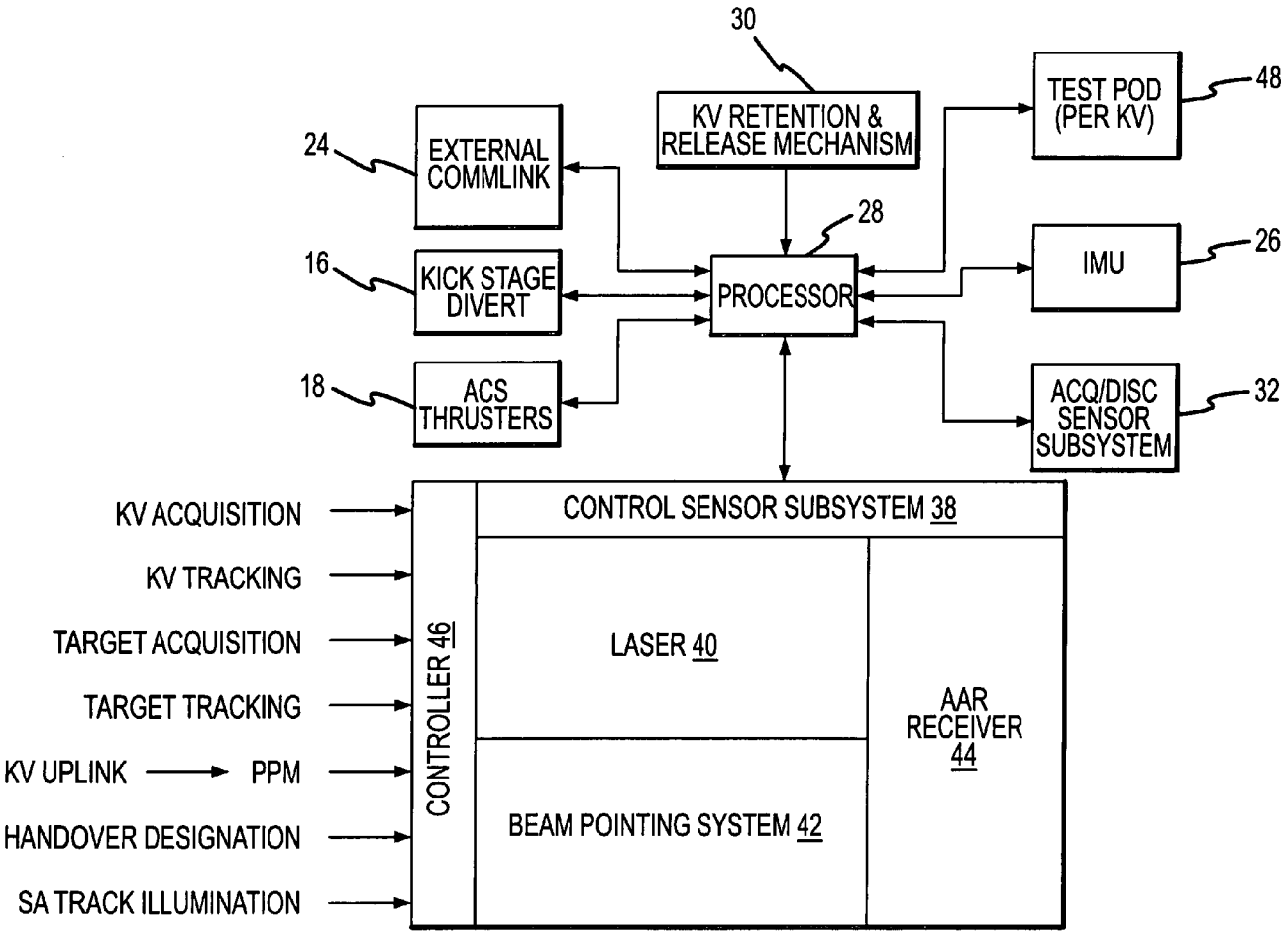
FIG. 2 is a simplified block diagram of the hardware components on the carrier vehicle.

As shown in FIGS. 1 and 2, an exemplary MKV interceptor 10 includes a carrier vehicle (CV) 12 and a plurality of KVs 14 initially stored in the carrier vehicle. For earth-based systems, the interceptor is launched using a multi-stage booster. A kick stage divert 16 separates the interceptor from the last stage of the booster and maneuvers the interceptor onto a nominal intercept trajectory. The kick stage may include axial and lateral divert capability through the center of gravity of the interceptor. An attitude control system includes multiple thrusters 18 offset from the center of gravity that provide yaw, pitch and roll control. Tanks 20 provide the propellant for the divert stage and ACS thrusters. Once the interceptor exits the earth's atmosphere a shroud 22 that protects the interceptor from contamination, aerodynamic pressure and heating during launch is jettisoned. An external commlink 24 is used to communicate with any source outside the interceptor. An Inertial Measurement Unit (IMU) 26 measures lateral accelerations and angular rates that are fed to the processor 28 to calculate the CV's position and attitude after a star fix initialization.

The KVs are stored in and then released from the CV by a KV retention and release mechanism 30. Conventional release mechanisms are fairly complicated in that they attempt to transfer the pre-release alignment of the KVs to the released KVs. This requires considerable control information to be exchanged between the CV and KVs and a sophisticated release mechanism. In the preferred embodiment, no requirements are placed on the release mechanism for maintaining inertial reference of the KVs. Consequently the release mechanism 30 can be a simple spring-loaded or gas-pressure mechanism without elaborate guiding mechanisms to constrain the release tip-off rate. The KVs are suitably kicked off with roughly controlled separation velocity but unknown or insufficiently known spin rate or orientation. As will be described below, the KVs are controlled to reacquire their direction to the CV to allow them to safely divert away from the CV and their inertial reference to allow them to divert to acquire track towards the targets. The KVs may be released with no knowledge or only enough knowledge to divert away from the CV but not to acquire track. This approach uses a simpler release mechanism 30. However, a conventional umbilical release mechanism may be used.

A discrimination and acquisition sensor subsystem 32 is mounted inside the CV. Discrimination optics 34 fold the light path so that the sensor is side-looking in this particular embodiment. The optics may be a fixed mirror or gimbaled mirror system. The gimbaled mirror system sweeps the sensors field-of-view (FOV) 36 over a certain angle to image a larger field-of-regard (FOR). The cues provided by the external systems are not precise enough to enable active sensing, the FOR of a laser illuminator is too narrow to acquire the targets. Therefore, the acquisition and discrimination sensor is suitably a longwave IR (LWIR) sensor having a relatively large FOV for passive detection. The sensor has a suitably large aperture to provide both the sensitivity and resolution required in a diffraction limited system. On account of the aperture size, the sensor is quite heavy, and thus the centralizing acquisition and discrimination on the CV reduces the burden on the KVs considerably. The sensor discriminates real targets from decoys, chaff, etc. and refines the tracking information for the real targets.

A control sensor subsystem 38 receives the refined tracking information for the real targets and provides active mid-course tracking to command guide the KVs until tracking is handed over to the KVs. The control sensor subsystem 38 includes a short-band laser 40, typically >10 W, a highly agile and very accurate beam pointing system (BPS) 42 that moves the laser's FOV over a FOR 43, an angle/angle/range (AAR) short-band IR receiver 44 and a controller 46 that allows the control sensor to accurately track multiple targets over a considerable distance and service different modes of operation. For mid-course tracking, latency, target resolution, and update rates are not critical. Also, at these ranges the laser's field of regard easily covers all targets.

The control sensor subsystem 38 is suitably configured to perform several different tasks.

KV acquisition: Controller 46 controls the laser to emit a low power pulsed beam and controls the BPS 42 to expand the beam to the maximum extent possible and to sweep the search volume where KVs might be located. Power is low due to the very short range and augmented KV reflective signature, but this is balanced against the expanded beam. As KVs are found the CV initializes tracks. This mode can not be used to establish the initial line-of-sigh from the KVs to the CV in cases where KVs must first divert to place themselves within the control sensor FOR.

KV Tracking: Controller 46 controls laser 40 to emit very low power pulses (close range & augmented reflection off KV) in a wide beam, which reduces the update rate necessary to keep the beam on the KV. The FOR is largest just after release and diminishes as CV-KV separation increases. The BPS 42 uses the latest tracking information and moves from one target to the next. The AAR Receiver 44 detects the return signature off of each of the illuminate targets and passes the information to processor 28, which updates the tracking information. KV Tracking typically begins before Target Tracking and continues until handover to the KVs.

Target Acquisition: The Acq/Disc sensor subsystem 32 hands over the refined tracking information for the real targets to the control sensor subsystem 38. Controller 46 tells the BPS 42 where to point laser 40. The refined tracking information is still relatively coarse when compared to the narrow FOV of the laser so the BPS may need to search to lock onto the targets. The laser is controlled to emit the highest pulse power within a narrow beam due to the range-to-target and target cross section. Initially the laser requires a small FOR to illuminate all of the targets that grows as the CV gets closer to the target cloud. It is possible to acquire targets sequentially with the laser (vs. multiplexing between them).

Target Tracking The laser is controlled to emit the highest pulse power within a narrow beam due to the range-to-target and target cross section. Initially the laser requires a small FOR to illuminate all of the targets that grows as the CV gets closer to target cloud. The BPS is controlled based on the last updated target track. The required update rate diminishes after a track state is established, until it increases again due to control range closure. The controller multiplexes the BPS and laser to track targets and KVs.

KV Uplink/PPM: Controller 46 keeps the laser on a KV for multiple pulses in order to send handover data from the CV to the KV. In one embodiment, the data is pulse position modulated (PPM), where the interval between adjacent pulses is used to encode the data.

Handover Designation: Controller 46 controls the BPS 42 to direct laser 40 to lase each of the targets (return signals are detected by the designated KVs). The controller suitably lases the targets in sequence so that any target within the angle uncertainty of the laser is not within the timing uncertain of KV detection. $R^4$ loss vs. CV acquisition (CV is closer to target, and KV is closer still, light return from target to KV) but smaller receive aperture so pulse power requirements may be greater or less depending on system details. In some embodiments may suspend KV tracking when this begins. The narrowest beam provides the highest return.

SA Track Illumination: Same $R^4$ loss issues as above, but expand beam as range closes to illuminate the entire target silhouette (so that the KV can measure a good aimpoint)

In a test mode, some number of KVs are replaced with a test pod 48 that stays on the CV and provides nominal CW illumination of the KV so that a electrically modulated retro reflector on the back of the KV can provide a multiple mbits per second data link back to the CV without significant imposition of power or resources. The test pod receives the reflected signals and reformats and remodulates them for transmission to telemetery receiving stations. KV will typically perform this remodulation using an electrically modulated retroflector. This allows the same component to serve as signature augmentation of KV track, and allows a full bandwidth test data link to be included in the KV with no significant weight or power impact to the KV.

Figure 3:
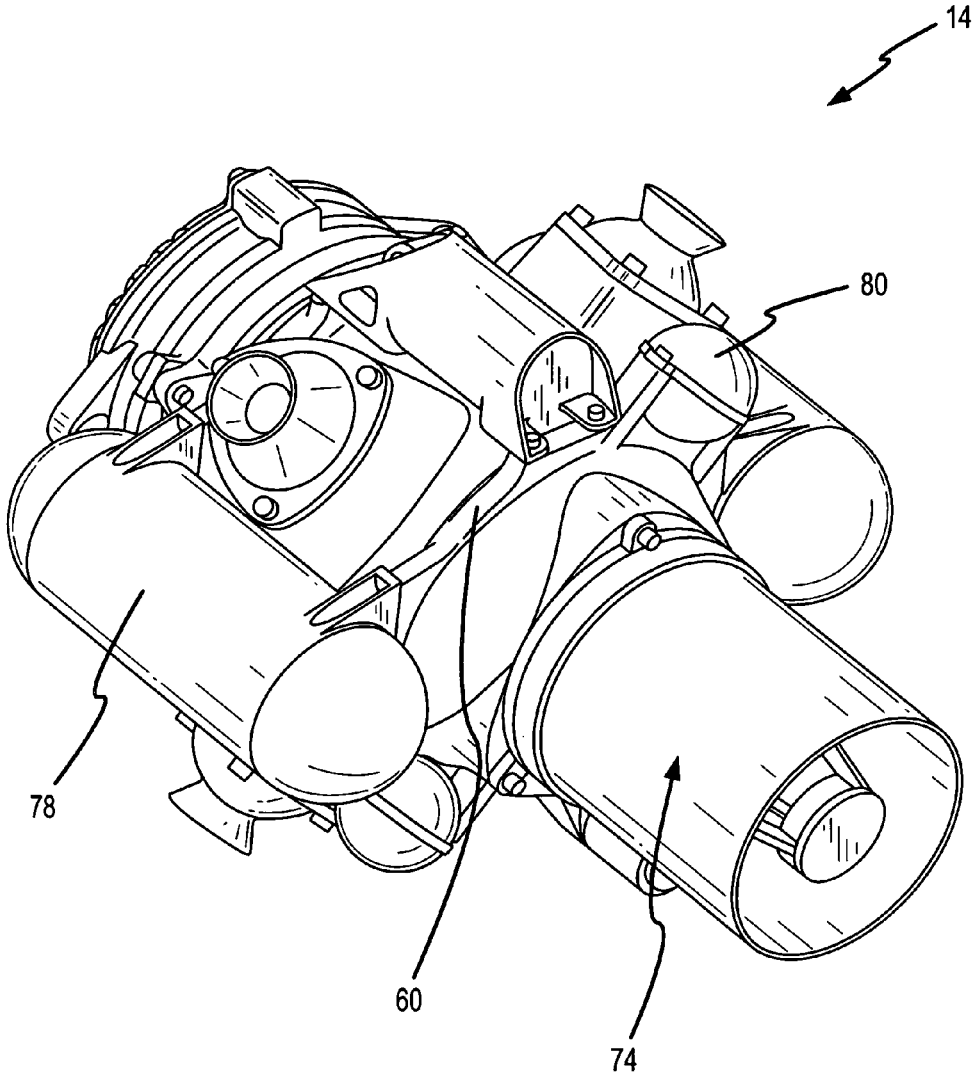
FIG. 3 is a diagram of an embodiment of a KV.
Figure 4:
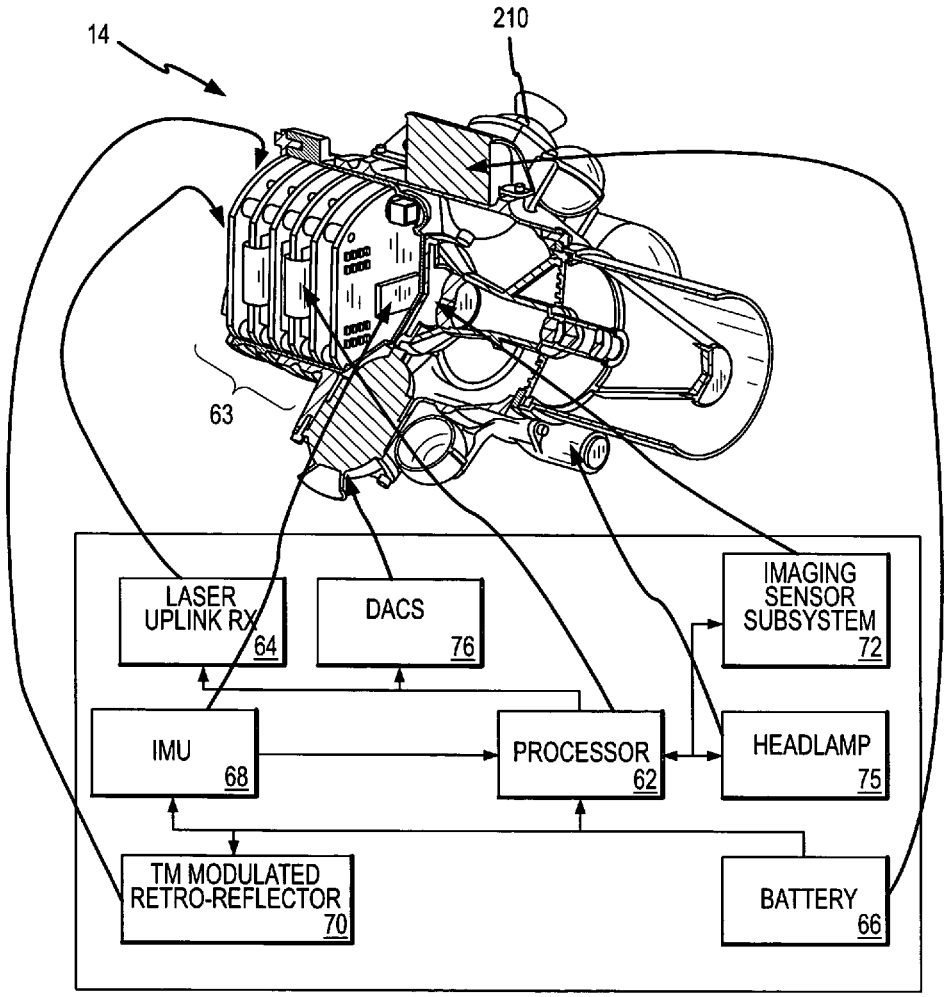
FIG. 4 is a simplified block diagram of the hardware components on the KV.

As shown in FIGS. 3 and 4, an exemplary KV 14 includes a chassis 60 on which is mounted a processor 62 as part of the avionics electronics 63 for controlling the KV and receiving data from the CV via laser uplink receiver 64. A battery 66 supplies electrical power to the KV. An IMU 68 measures lateral accelerations and angular rates that are fed to the processor 62 to calculate the KV's position and attitude after a star fix initialization. A telemetry (TM) modulated retroreflector 70 provides KV signature augmentation to aid CV tracking of the KV as well as modulation for the test data link described previously.

Each KV includes an imaging sensor subsystem 72. On account of KV weight considerations, in order to provide sufficient independent pixels on target at a certain range-to-target post-handover to select a desired aimpoint, the imaging sensor must detect in a shorter band than the LWIR band typically used for passive acquisition. In diffraction limited systems to obtain the same resolution a longer band sensor requires a much larger aperture, hence is much heavier.

In one exemplary embodiment described herein, imaging sensor subsystem 72 comprises a short-band sensor, suitably an uncooled FPA in the visible and/or near-visible bands, generally referred to as the 1 micron band, approximately 200 nm to 16 nm, which are generally incapable of passive detection of typical targets. The imaging sensor is shielded from stray sunlight by a sun shade 74.

Figure 5A:
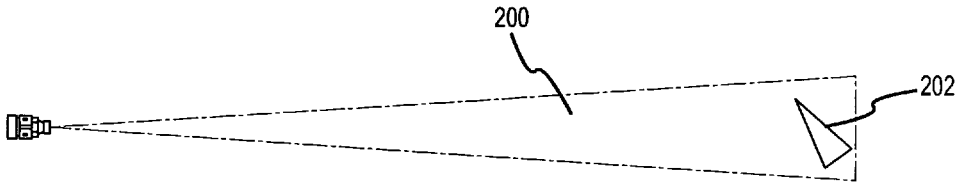
FIGS. 5*a* and 5*b* are diagrams illustrating a varying headlamp FOV to maintain full coverage of target as the KV approaches.
Figure 5B:
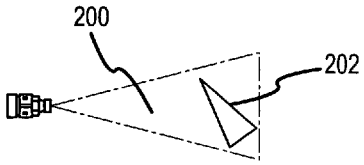

These short-band imaging sensors require the target to be illuminated. The sun is an adequate source of illumination but is not always available. On-board illumination is provided by a headlamp 75 mounted on the KV. The headlamp does not have to be coherent, e.g. LEDs typically used in terrestial data communications are sufficient. As shown in FIG. 5*a*, the headlamp beam 200 is sized to cover the target 202 plus any pointing uncertainty. Beam size requirements at acquisition ranges where power is most at issue can be reduced by vernier beam steering control. This can be achieved via a small-FOV liquid crystal beam device or by filling the beam using a plurality of angularly separated emitters and selecting the subset desired for the current beam. As the KV closes on the target, the headlamp beam 200 is suitably expanded to maintain full coverage of the target 202 as shown in FIG. 5*b*. In most configurations, a two-FOV switch is sufficient and be implemented using a lightweight liquid crystal device that when activated provides a second FOV. A more complex liquid crystal device can provide steering as well as programmable defocus allowing the beam size to be reduced. Alternately, the KV can simply switch portions of the illuminator array on and off to maintain coverage. The imaging sensor subsystem detects the return signal from the target illuminated by its headlamp 75 and passes the data to processor 62.

In another exemplary embodiment, imaging sensor subsystem 72 includes a MWIR imaging sensor that provides suitable resolution for aimpoint selection and terminal guidance albeit with a larger aperture. The MWIR imaging sensor may also be used to acquire the target at handover if the range-to-target (assuming earth umbra) is fairly small. Alternately, the subsystem also includes a LWIR sensor to acquire the target at handover at more typical handover ranges, transitioning to MWIR to provide adequate aimpoint resolution when the KV approaches the target. The dual LWIR/MWIR can be implemented using separate FPAs imaged with different focal lengths, a common two-color FPA with the two paths imaged at different focal lengths, or with a single two-color FPA and a common focal length. In the latter case, the FPA is oversampled in MWIR operation and sacrifices MWIR FOV for LWIR resolution. The system may be configured so that the focus for the MWIR band is tailored to the aimpoint designation range, separately from the LWIR handover, reducing defocus for terminal aimpoint selection. Rather than tailoring the imaging sensor subsystem optics to maintain the same focus across the detection band, performance may be improved by tailoring focus to match the needs of the LWIR and SWIR sensors.

Figure 6A:
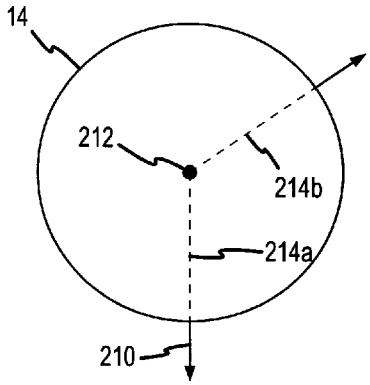
FIGS. 6*a* through 6*c* are diagrams illustrating implicit ACS with two, three and four divert thrusters.
Figure 6B:
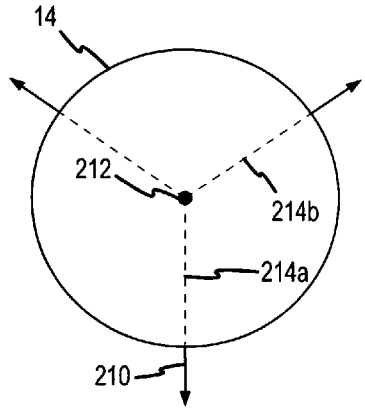
Figure 6C:
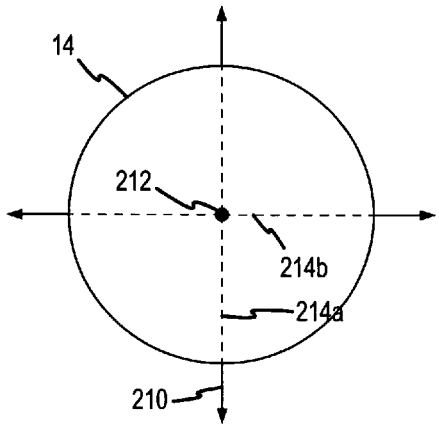

For either imaging sensor configuration, the processor updates the target track and controls the divert & attitude control system (DACS) 76 to adjust the heading of the KV to the updated target track. Fuel tanks 78 fuel the DACS thrusters and fuel pressurant 80 maintains the pressure inside the fuel tanks. The DACS includes at least two divert thrusters 210 having two-axis articulation, nominally 1-2° in each direction is adequate, that are off-axis from the body axis 212 of the KV 14. In many KVs, the thrusters may be angled at least 45° off-axis and suitably nominally perpendicular to the body axis as shown in FIGS. 6*a*-6*c* although other combinations where at least one of the thrusters is off-axis are feasible. At least two of the divert thrusters are spaced on the KV so that their nominal lines of thrust 214*a* and 214*b* are separated by more than 90°. The at least two divert thrusters provide divert and attitude control in all three axis; yaw, pitch and roll. Although two divert thrusters as shown in FIG. 6*a* can provide 3-axis control, certain intermediate maneuvers may be required to achieve all three axis. As shown in FIG. 6*b*, three divert thrusters can provide 3-axis control directly but may require compensatory thrust to achieve pure attitude control. As shown in FIG. 6*c*, a four thruster configuration provides efficient 3-axis control.

The implicit DACS can be used to align the lines of thrust through the KV's center-of-gravity to negate or at least minimize any induced attitude disturbances on pure divert maneuvers. Such maneuvers tend to be a strong driver on the ACS, increasingly so for small KVs. Sensors on-board the KV sense any induced attitude change and an error signal is generated and feedback to zero out the attitude change. The implicit ACS can be used to misalign the lines of thrust to be offset from the center-of-gravity to create a desired attitude control. Sensors on-board the KV sense the induced attitude change, compare it to the desired attitude maneuver and generate an error signal to control the alignment to achieve the desired change. Note, the center-of-gravity does not necessarily lie on the body axis and will change during flight as propellant is used. Although described here in the context of providing divert and attitude control for a KV, the implicit DACS is more generally applicable to other space vehicles such as satellites.

Each KV is relatively small, typically about one foot long and lightweight in some cases as little as 2 kg. But at very high closing velocities, the KV possesses considerable kinetic energy, enough to kill incoming warheads if the aimpoint on the target is properly selected and the KV impacts the target precisely on the aimpoint. The inclusion of a short-band or MWIR imaging sensor subsystem 72 on each KV provides high resolution images of the targets sufficient to precisely determine the aimpoint and to provide terminal tracking to impact.

An exemplary embodiment for intercepting exo-atmospheric targets using the MKV interceptor described above is illustrated in FIGS. 7 through 14 including the stages of (1) launch & pre-release guidance, (2) KV release and divert, (3) target acquisition & discrimination, (4) active midcourse tracking (5) hand-over to the KVs, (6) semi-active track (optional) and (7) aimpoint selection and terminal guidance. Stages 1-4 are common to both the MWIR/LWIR sensor and headlamp illuminated short-band sensor embodiments. From there the MWIR/LWIR embodiment acquires the KVs in a passive handover and selects the aimpoint passively whereas the headlamp embodiment acquires the KVs in a semi-active handover and selects the aimpoint actively. It would be possible to use semi-active handover in conjunction with a MWIR sensor for performing aimpoint selection and terminal guidance.

Launch & Pre-Release Guidance

Figure 7:
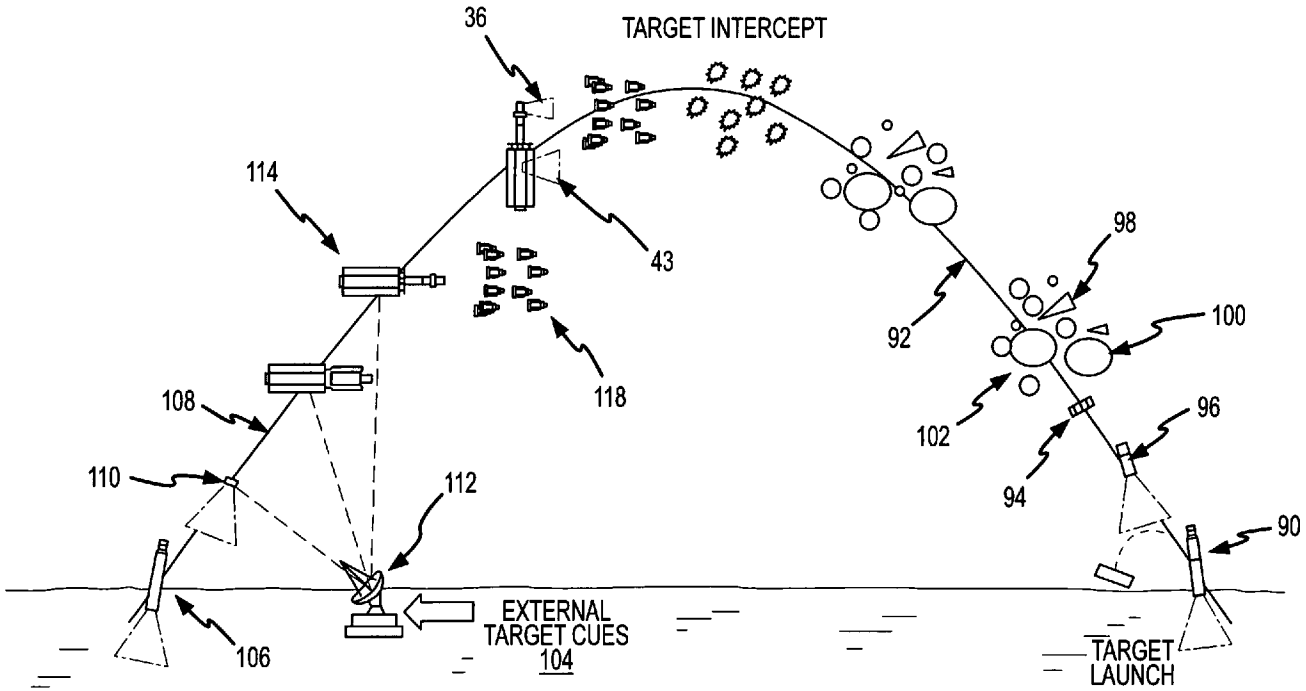
FIG. 7 is a diagram of an MKV interceptor launch to intercept multiple exo-atmospheric targets.

As shown in FIG. 7, a hostile missile 90 is launched on a ballistic trajectory 92 towards a friendly target. The MIRV warhead 94 separates from the boost stage 96 and the multiple RVs (targets) 98 and decoys, chaff, etc. 100 for a target cloud 102 that generally follows the ballistic trajectory. The targets may deviate from this trajectory either unintentionally upon re-entry into the atmosphere or intentionally to defeat a missile defense system.

A missile defense system includes a number of external systems that detect missile launch, assess the threat, and determine external target cues 104 (ballistic trajectory, time to intercept, number of RVs, etc.). The defense system launches one (or more) MKV interceptors 106 along an initial intercept track 108 based on those external target cues. Once aloft, the interceptor drops the booster stage 110 and jettisons the shroud. The interceptor is suitably tracked by a ground based radar installation 112 and engages it's divert and ACS systems to put the interceptor on the initial intercept track.

KV Release and Divert

Figure 8A:
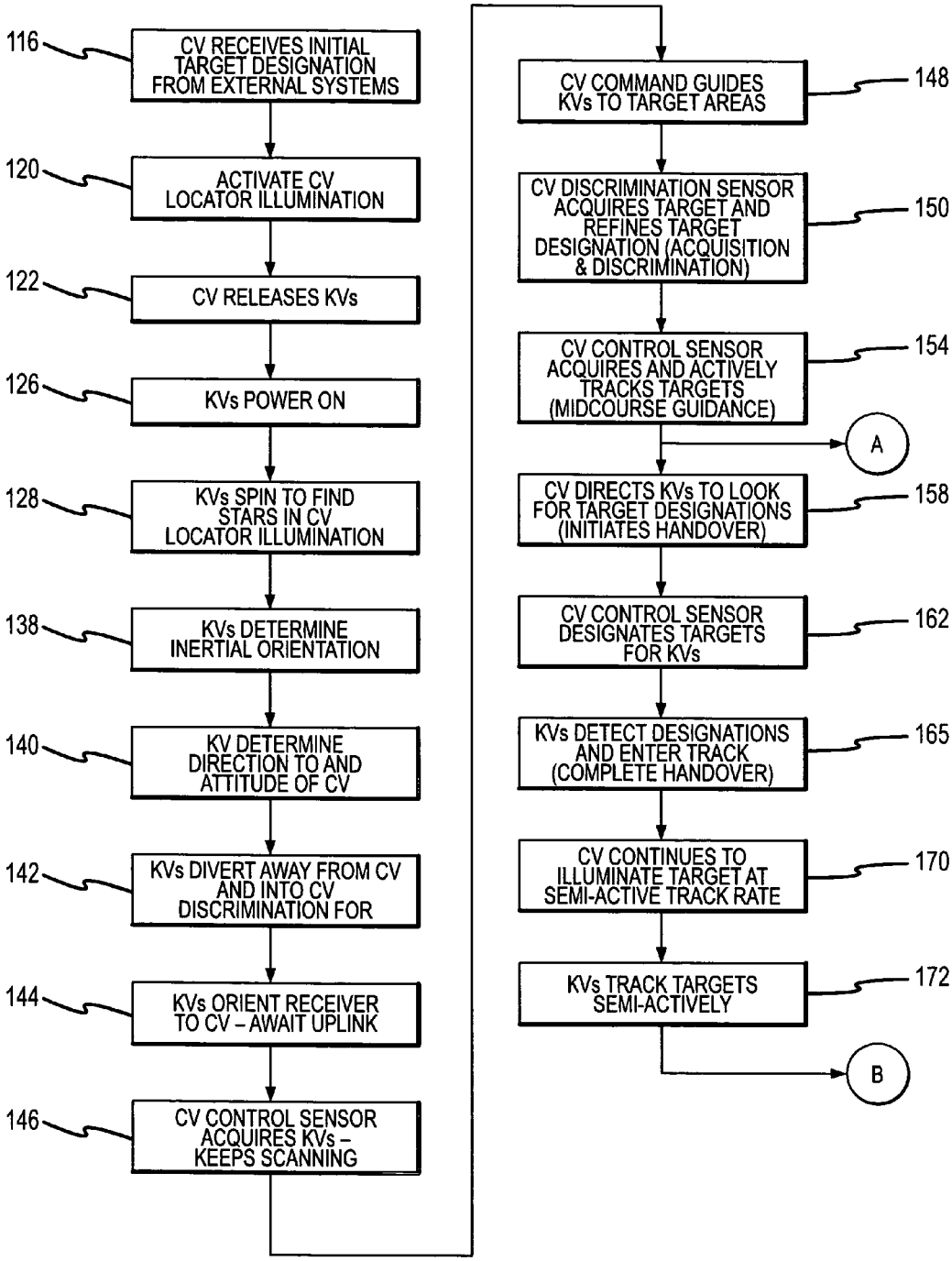
FIGS. 8*a* and 8*b* are flowcharts of the CV and KV actions from target designation to intercept.
Figure 8B:
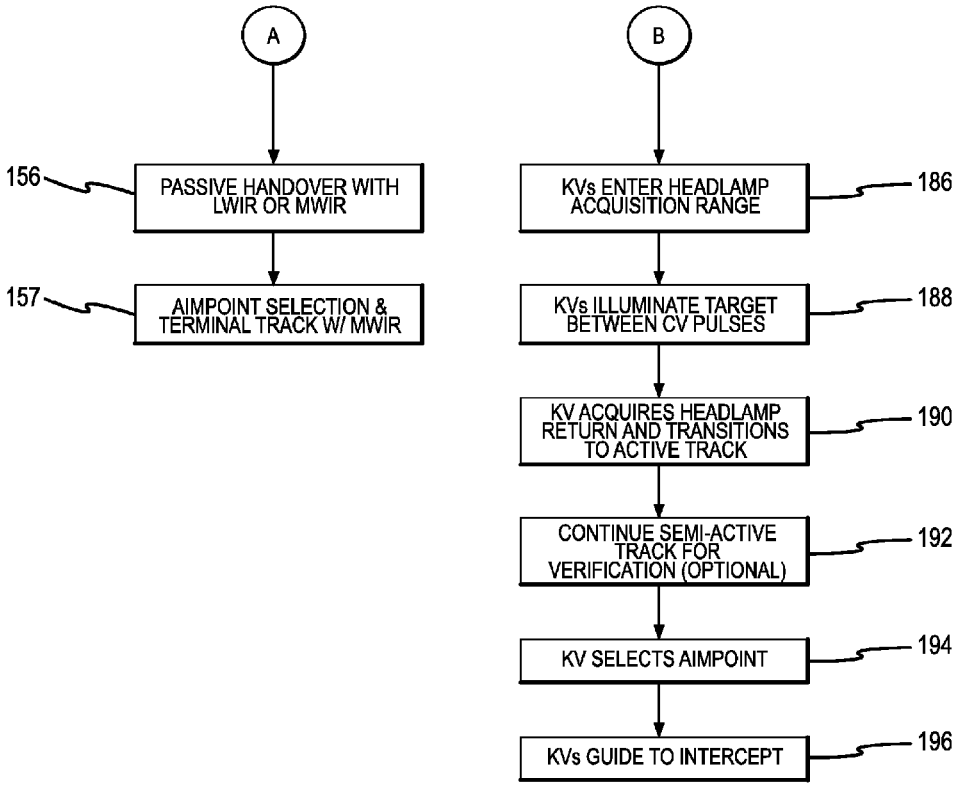

Once the initial intercept track 108 has been established, as shown in FIGS. 8*a* and 8*b*, the CV 114 receives initial target designation from external systems or cues (step 116) releases the KVs 118 (step 120). The CV activates an illumination source (step 122), suitably a few simple LEDs 124 around the CV that will allow the KV uplink sensors to "see" the CV and determine its relative position and major orientation. In one implementation, the light would blink in a pattern so that a non-imaging sensor could separately measure the angle to each point on the CV. It is generally preferable to have the KVs separate from the CV early, once the interceptor is out of earth atmosphere, to give them sufficient time to achieve a desired separation from the CV in order to conserve propellant. KVs typically will not all be released at the same time, one ring at a time is preferable. This minimizes the risk of collisions among other benefits.

Figure 9A:
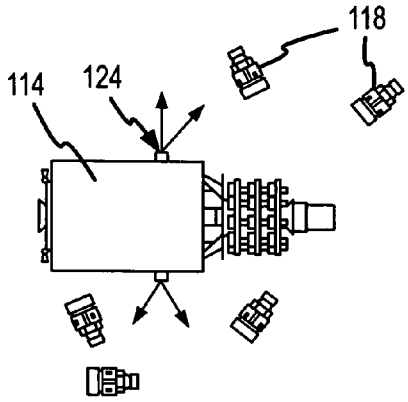
FIGS. 9*a* through 9*d* are diagrams illustrating the release of the KVs, initiated spin to acquire KV orientation, minimum number of stars acquired for a given swath and alignment of data link receiver to the CV.

As shown in FIG. 9*a*, KVs 118 are suitably released with insufficient information to be able to safely divert without risking running into each other or the CV and/or to be able to divert to acquire track towards the target. This lack of orientation knowledge also precludes more conventional alignment methods, such as GPS maneuver realignment, that require KV lateral divert before the orientation can be discerned. The KVs will typically have a controlled separation velocity but an unknown or insufficiently known spin rate and orientation. Alternately, the CV and KVs may be configured using standard umbilical technology and more complex release mechanisms well known in the art to maintain their inertial reference and heading.

Figure 9B:
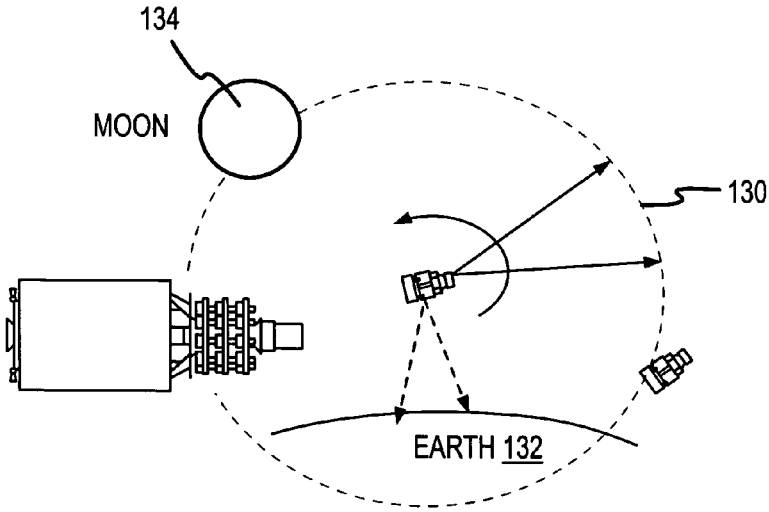

As shown in FIG. 9*b*, the KVs are powered on (step 126) and initiate a spin to find stars in the CV illumination (step 128). Each KV continuously sweeps its narrow FOV imaging sensor subsystem 72 perpendicular to its line of sight through as much as 360 degrees in a few seconds. This guarantees covering a swath of unoccluded stars 130 of at least 1 deg×20 deg regardless of the initial orientation. The sensor may image the earth 132, the moon 134, the CV or other KVs. These swaths are easily discriminated from star patterns and eliminated using image processing techniques well known to those in the art. Starting at any star and sweeping the FOV +/− in any arbitrary direction, the FOR length (deg) necessary to include a given # of stars (vs. FOV) is shown in table 136 in FIG. 9*c*. As shown, all 1 deg×20 deg swaths contain at least 10 stars detectable by conventional uncooled focal plane arrays (FPA) at a reasonable KV spin rate (magnitude 6.5 or brighter). The map of all such stars fits easily in the processor memory. Each KV uses its swath of at least 10 stars to determine an inertial orientation (step 138) by matching against the pre-stored star map using conventional techniques. As is known in the art, five stars are sufficient to determine a precise orientation match (Kayser-Threde). Each KV also determines its direction to the CV using the illumination from the CV (step 140).

Figures 9C, 9D:
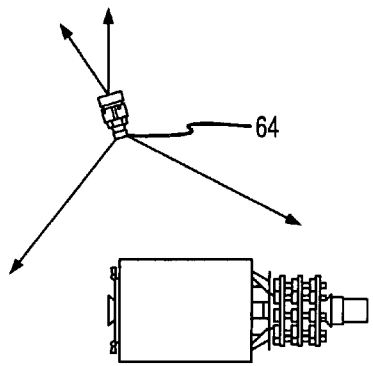

Using their inertial reference and direction to the CV, the KVs use DACS 76 to divert away from CV and into the FOR of the control sensor to receive their initial target divert commands (step 142). This will also allow the CV to track the KVs and reduce errors in command guidance. Each KV orients its wide FOV uplink receiver 64 to the CV as shown in FIG. 9*d* and awaits uplink of initial commands from the CV for each KV (step 144). This methodology precludes the need for a separate datalink to notify the CV of whether each individual KV passed its built-in-test (BIT) at power up. Only those KVs that passed divert into the control sensor's FOV. Those KVs that's do not show up, failed.

The CV's control sensor subsystem 38 acquires the KVs (step 146) and, based on the initial track from external cues, commands the KVs for an initial divert toward the toward the target areas (step 148). In most cases the KVs will be commanded to separate into waves that reach the target seconds apart. In some cases, the KVs may be given updated commands based on revised ground cues before discrimination sensor acquisition. These steps are suitably done prior to "Target Acquisition & Discrimination" to get all of the KVs moving in the right direction as early as possible to minimize divert requirements, but could be done afterwards. In the particular CV configuration shown in FIG. 1, the interceptor flies sideways toward the targets so the side-looking control sensor subsystem 38 and ACQ/DISC sensor subsystem 32 can see the KVs and targets as shown in FIG. 10.

Target Acquisition & Discrimination

Figure 10:
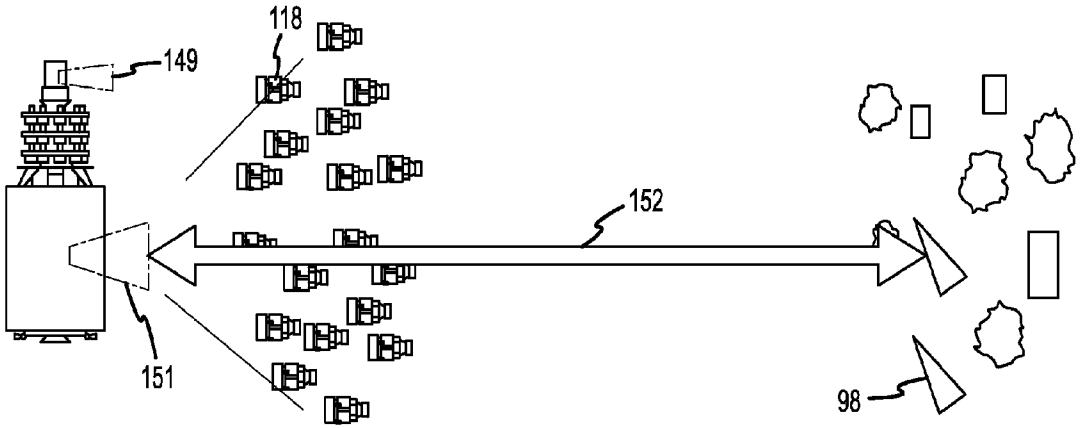
FIG. 10 is a diagram illustrating CV tracking of the KVs and targets for midcourse guidance pre-handover.

The CV's LWIR passive acquisition and discrimination sensor subsystem 32 acquires the targets within its FOV 149 as shown in FIG. 10 and refines the target discrimination and tracking cues (step 150). Methods for passive LWIR acquisition and discrimination of real targets from a target cloud are known in the art and beyond the scope of the present invention. However, the centralization of the acquisition and discrimination functions on the CV greatly simplifies the design of the KVs and reduces the complexity of the target discrimination and designation process.

Active Mid-Course Guidance

Once candidate targets have been acquired and their track information refined, the CV's control sensor subsystem 38 actively track the targets with a narrow FOV 151 pulsed laser beam 152 and command guides the KVs (step 154). Although it is conceptually possible to use active tracking to perform acquisition and tracking it would be very difficult. The FOV of the laser is very narrow, and thus it is difficult to image a target based on the relatively coarse tracking information provided by the external cues. Furthermore, active tracking of all the potential targets in the target cloud heavily burdens the capability of the BPS. Therefore, relatively wide FOV passive LWIR sensors are more suitable for acquisition and discrimination. As shown in FIG. 10, the CV preferably actively tracks both the targets 98 and the KVs 118 to eliminate sources of error in the guidance commands.

Passive MWIR Imaging Sensor

Handover of Target Designations & Tracking to KVs

The KV's MWIR imaging sensor can be used to acquire target designations and continue tracking either in sunlight illumination or in earth umbra at very short range to target (step 156). This requires that either the CV be able to command guide the KVs very close to the targets or that the CV and KVs be able to semi-actively track the KVs very close to the targets.

Another option is to a LWIR sensor in the imaging sensor subsystem to handle target acquisition at handover (step 156). The LWIR sensor is capable of acquiring the target at much longer, and more typical, handover ranges in earth umbra. When the KV closes on the target, tracking is transitioned from the LWIR sensor to the MWIR sensor.

Aimpoint Selection & Terminal Track to Intercept

The MWIR sensor provides sufficient resolution of the target to select the desired aimpoint and maintain track on the aimpoint until intercept (step 157) albeit with a larger aperture and heavier FPA than a short-band sensor.

Active Short-Band Imaging Sensor

Handover of Target Designations & Tracking to KVs

At some range-to-target, primary tracking responsibility is transferred from the CV to the individual KVs ("Handover"). The range-to-target is determined by the sensitivity (aperture size) and resolution capabilities of the KV's imaging sensors, and the power of the CV illuminator (for SA handover) or the target intensity for passive handover.

Figure 11:
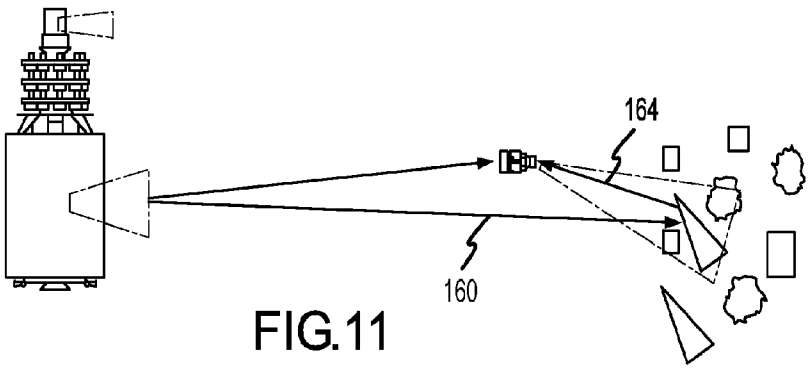
FIG. 11 is a diagram illustrating the CV laser designation of the targets to facilitate handover to the KVs and post-handover to facilitate semi-active track until the range-to-target is close enough for autonomous acquisition by the KVs.
Figure 12A:
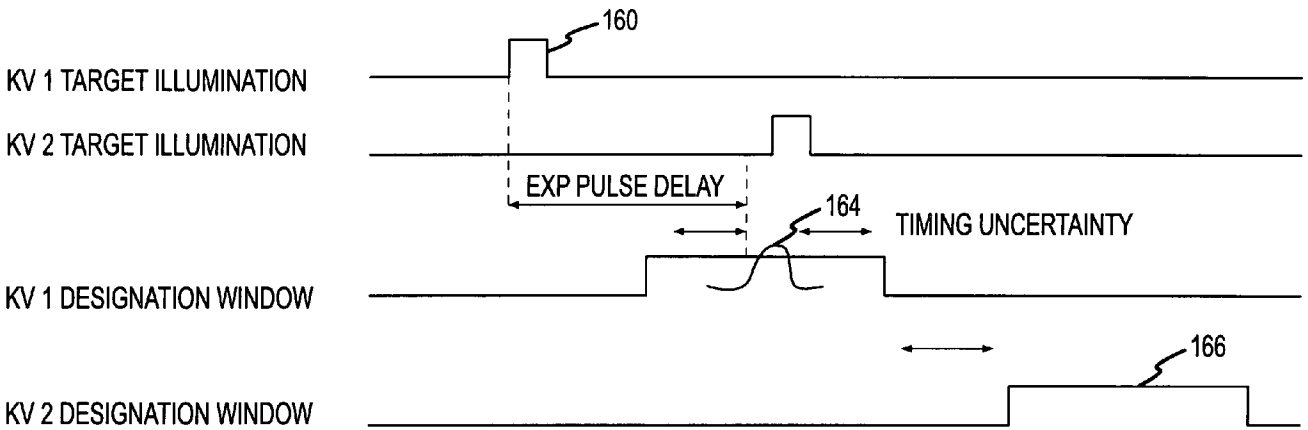
FIGS. 12*a* and 12*b* are a timing diagram of the laser designation and gating of the KVs' imaging sensors and QWERTY scan to facilitate handover.

In an embodiment, the CV's control sensor subsystem 38 and the KV's imaging sensor 72 are used to both designate the targets for each KV and handover the current tracking. This is enabled because the emission band of the control sensor laser 40 overlaps the detection band of the KV's imaging sensor 72. The CV initiates handover by directing the KVs to look for target designations in a particular direction at a particular time (step 158). The CV control sensor subsystem illuminates the targets with a pulsed beam 160 to designate the targets as shown in FIG. 11 (step 162) and the KVs detect return signals 164 from their designated targets and enter track (step 165). As shown in FIG. 12*a*, a particular KV will look for its designated target within a "designation window" 166 to detect the return signal. This approach effectively eliminates the complexities and potential failures from matching detections between passive CV and KV sensors.

Figure 12B:
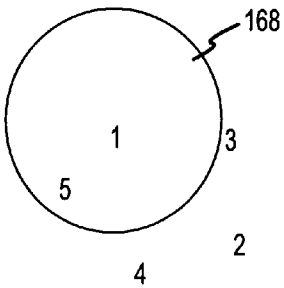

To reduce the likelihood of mis-designation, the targets are illuminated in QWERTY scan order reminiscent of the typewriter keyboard layout. As shown in FIG. 12*b*, a QWERTY scan designates the targets in order 1,2,3,4,5, . . . so that any target within the angle uncertainty of the imaging sensor's FOV 168 is not within the timing uncertainty of the designation. As with the typewriter, this temporally separates actions that are spatially nearby.

Another common approach would be to have each KV detect nearby illumination "pings" within its FOV and correlate that information to uplinked data to determine the target designation.

Semi-Active Post-Handover Tracking

In many applications, it may be desirable prior to entering terminal guidance to intercept to "semi-actively" track the targets using the CV's control sensor laser and BPS to illuminate the targets (step 170) and each KV's imaging sensor subsystem to detect the return signals and update the track (step 172). Semi-active tracking provides the combined benefits of the CV's powerful laser and agile BPS with the range-to-target (resolution, latency) advantages of the KV's imaging sensor. This combined with updating the guidance track on each KV provides for more accurate tracking.

Aimpoint Selection & Terminal Track to Intercept

Figure 13:
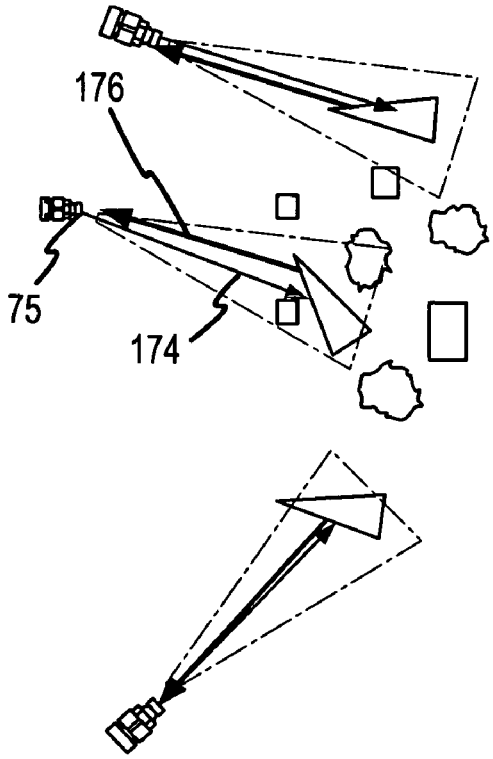
FIG. 13 is a diagram illustrating aimpoint selection and terminal guidance by the KV's on-board imaging sensors under headlamp illumination.

To enable aimpoint selection on the target with sufficient accuracy and to track the target to impact the selected aimpoint, a headlamp 75 illuminates the targets with a pulsed beam 174 as shown in FIG. 13. As the KV closes on the target, the headlamp can widen its FOV to cover the target. The return signals 176 are then detected by the appropriate KV. The headlamp is suitably "short pulsed" and the imaging sensors gated to suppress dark current and improve SNR.

In diffraction limited systems, for a given aperture size the only practical way to increase resolution is to use shorter wavelength sensors (super-resolution methods based on sensor motion have been proposed, but are unsuitable in such a highly dynamic environment). A KV can only support so much weight, which restricts the aperture too fairly small diameters, hence short-band sensors are preferable. These short-band sensors cannot adequately detect a passive signature for targets in the temperature range expected for missile defense systems, hence the need for external illumination. In some applications, it may be desirable to also include a passive MWIR sensor to provide redundancy.

Figure 14A:
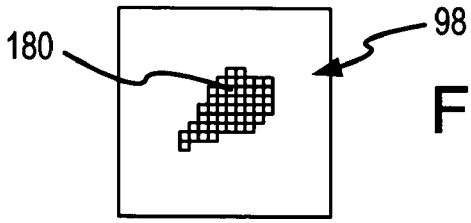
FIGS. 14*a* through 14*c* are sensor images of a representative target for a given aperture size for the KV's short band imaging sensor and the CV's long band discrimination sensor, and for a given short band sensor mounted on the CV at typical stand-off distance.
Figure 14B:
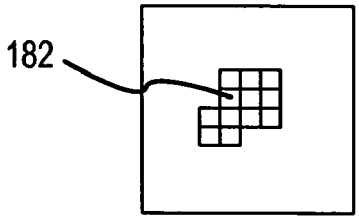
Figure 14C:
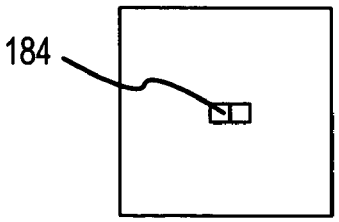

As shown in FIG. 14*a*, for a given aperture size of 2-3 inches a 0.96 micron imaging sensor produces sufficient independent pixels 180 on target to resolve both the shape and orientation of the target. By comparison an 8 micron sensor with the same aperture size only produce sufficient pixels 182 on target to determine an image centroid as shown in FIG. 14*b*, which is typical of most systems. However, recent studies have shown that guiding based on the centroid is not optimal and may be insufficient to destroy the target. Therefore, it is very important to resolve the target to be able to pick a particular aimpoint and then guide the KV to that aimpoint at impact. Also by comparison, a 0.96 micron imaging sensor located on the CV would only image a very few pixels 184 on target as shown in FIG. 14*c* due to its much greater stand-off range. Again this is only adequate to determine an image centroid aimpoint.

Once the KVs enter headlamp acquisitions range (step 186), the headlamp is turned on and illuminates the target between CV pulses (step 188). Each KV acquires its headlamp return and transitions to active track (step 190). The CV may continue semi-active tracking for verification (step 192) but this is optional. The KVs determine the precise aimpoint on the target as resolution and range-to-target permit (step 194) and the KVs process the return signals and guide to intercept (step 196). This approach has the benefit of using a headlamp that is much lower power than the CV laser source and having only a limited pointing system if any but does require a headlamp on each KV.

While several illustrative embodiments of the invention have been shown and described, numerous variations and alternate embodiments will occur to those skilled in the art. Such variations and alternate embodiments are contemplated, and can be made without departing from the spirit and scope of the invention as defined in the appended claims.

We claim:

1. A multiple kill vehicle (MKV) interceptor for intercepting targets, comprising:

a carrier vehicle (CV); and a plurality of kill vehicles (KVs) initially stored in said carrier vehicle for release to intercept the targets;

said CV including a first sensor subsystem for tracking said targets and command guiding the released KVs pre-handover; and each said KV including a headlamp for illuminating a target, a short-band imaging sensor subsystem for detecting the headlamp return off the illuminated target and a processor to select a desirable aimpoint on the target post-handover and maintain track on the aimpoint to terminal intercept.

2. The MKV interceptor of claim 1, wherein the imaging sensor provides sufficient independent pixels on target to use shape and orientation of the target to select the aimpoint.

3. The MKV interceptor of claim 1, wherein the headlamp illumination is pulsed and the KV's imaging sensor is gated to detect the headlamp return from the target.

4. The MKV interceptor of claim 1, wherein the imaging sensor detects in the visible and/or near visible bands.

5. The MKV interceptor of claim 1, wherein the headlamp includes an array of one or more LEDs.

6. The MKV interceptor of claim 1, wherein the FOV of the headlamp illumination is increased as the KV closes on the target to cover the target.

7. The MKV interceptor of claim 1, wherein the headlamp illuminates the entire image silhouette of the target.

8. A multiple kill vehicle (MKV) interceptor for intercepting targets, comprising:

a carrier vehicle (CV); and a plurality of kill vehicles (KVs) initially stored in said carrier vehicle for release to intercept the targets;

said CV including a first sensor subsystem for tracking said targets and command guiding the released KVs pre-handover; and each said KV including a MWIR imaging sensor subsystem for detecting a passive signature from a target and a processor to select a desirable aimpoint on the target post-handover and maintain track on the aimpoint to terminal intercept.

9. The MKV interceptor of claim 8, wherein the MWIR imaging sensor subsystem acquires the targets from the CV at handover.

10. The MKV interceptor of claim 8, wherein each said KV further includes a LWIR sensor for acquiring the targets from the CV at handover.

11. A multiple kill vehicle (MKV) interceptor for intercepting targets, comprising:

a carrier vehicle (CV); and a plurality of kill vehicles (KVs) initially stored in said carrier vehicle for release to intercept the targets;

said CV including a first sensor subsystem for tracking said targets and transmitting heading commands to command guide the released KVs pre-handover; and each said KV comprising;

an imaging sensor subsystem for detecting a signature from a target, a divert and attitude control system (DACS) that includes at least two divert thrusters having two-axis articulation with at least one of the divert thrusters mounted off-axis to a body axis of the KV, at least two of the divert thrusters being spaced on the KV so that their nominal lines of thrust are separated by at least 90°; and a processor that (a) controls the DACS to perform divert and attitude maneuvers to execute the heading commands pre-handover, and (b) processes the signature to select a desirable aimpoint post-handover and to control the DACS to perform divert and attitude maneuvers to maintain track on the aimpoint to terminal intercept.

12. The MKV interceptor of claim 11, wherein the DACS includes three or four divert thrusters.

13. The MKV interceptor of claim 11, wherein the DACS aligns the lines of thrust through the KV's center-of-gravity to minimize any induced attitude disturbances from pure divert maneuvers.

14. The MKV interceptor of claim 11, wherein the DACS offsets the lines of thrust from the KV's center of gravity to create to perform a desired attitude maneuver.

15. A kill vehicle (KV) for use with an MKV interceptor, comprising:

a divert and attitude control system (DACS) for controlling the heading of the kill vehicle;

a headlamp for illuminating a designated target;

a short-band imaging sensor subsystem for detecting a headlamp return from the illuminated target; and a processor that processes the return signal to select a desirable aimpoint on the target and controls the DACS to maintain track on the aimpoint to terminal intercept.

16. The KV of claim 15, wherein the short-band imaging sensor subsystem detects in approximately the 1 μm band.

17. The KV of claim 15, wherein the headlamp includes an array of LEDs.

18. The KV of claim 15, wherein the headlamp has a variable FOV.

19. A kill vehicle (KV) for use with an MKV interceptor, comprising:

a divert and attitude control system (DACS) for controlling the heading of the kill vehicle;

a MWIR imaging sensor subsystem for detecting a passive signature from a designated target; and a processor that processes the signature to select a desirable aimpoint on the target and controls the DACS to maintain track on the aimpoint to terminal intercept.

20. The KV of claim 19, wherein each said KV further includes a LWIR sensor for acquiring the targets prior to aimpoint selection.

21. A space vehicle, comprising:

a divert and attitude control system (DACS) that includes at least two divert thrusters having two-axis articulation with at least one of the divert thrusters mounted off-axis to a body axis of the space vehicle, at least two of the divert thrusters being spaced on the space vehicle so that their nominal lines of thrust are separated by more than 90°; and a processor that controls the DACS to perform divert and attitude maneuvers to guide the space vehicle.

22. The space vehicle of claim 21, wherein the DACS includes three or four divert thrusters.

23. The space vehicle of claim 21, wherein the DACS aligns the lines of thrust through the space vehicle's center-of-gravity to minimize any induced attitude disturbances from pure divert maneuvers.

24. The space vehicle of claim 21, wherein the DACS offsets the lines of thrust from the space vehicle's center of gravity to perform a desired attitude maneuver.

* * * * *